US007624681B2

(12) United States Patent
Goodman et al.

(10) Patent No.: US 7,624,681 B2
(45) Date of Patent: Dec. 1, 2009

(54) INITIATOR ACTIVATED BY A STIMULUS

(75) Inventors: Kenneth R. Goodman, Cypress, TX (US); Christian C. Spring, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 416 days.

(21) Appl. No.: 10/908,320

(22) Filed: May 6, 2005

(65) Prior Publication Data

US 2006/0249045 A1 Nov. 9, 2006

(51) Int. Cl.
*F42B 1/02* (2006.01)

(52) U.S. Cl. ..... 102/310; 89/1.15

(58) Field of Classification Search ..... 102/202.5, 102/202.6, 202.7, 201, 217, 218, 320, 322, 102/306–310; 89/1.15; 175/4.55–4.59
See application file for complete search history.

(56) References Cited

U.S. PATENT DOCUMENTS

| | | | | | |
|---|---|---|---|---|---|
| 4,699,241 | A * | 10/1987 | Kerekes | ..... | 181/116 |
| 4,971,160 | A | 11/1990 | Upchurch | | |
| 5,022,485 | A * | 6/1991 | Mitchell | ..... | 181/106 |
| 5,369,579 | A * | 11/1994 | Anderson | ..... | 702/11 |
| 5,490,563 | A * | 2/1996 | Wesson et al. | ..... | 166/297 |
| 7,104,326 | B2 * | 9/2006 | Grattan et al. | ..... | 166/297 |
| 7,172,023 | B2 * | 2/2007 | Barker et al. | ..... | 166/297 |

* cited by examiner

*Primary Examiner*—James S Bergin
(74) *Attorney, Agent, or Firm*—James L. Kurka; Kevin B. McGoff; Trop, Pruner, Hu PC

(57) ABSTRACT

A detonator assembly for initiating an explosive comprises a power source, an initiator, and a switch coupled between the power source and initiator. The switch has a trigger input responsive to a stimulus to activate the switch, where activation of the switch causes electrical energy to be provided to the initiator. The stimulus comprises at least one of a clock-based stimulus, a pressure stimulus, a light stimulus, an acoustic stimulus, and a vibration stimulus.

20 Claims, 2 Drawing Sheets

INITIATOR ACTIVATED BY A STIMULUS

BACKGROUND

Explosive devices are used in a well environment for various purposes. The most common use of an explosive device in a well is to create perforations in casing and formation surrounding a wellbore. Other applications of explosive devices include cutting through various other types of downhole structures, and activating downhole tools such as packers. Also, explosive devices are used in mining operations and other surface applications (e.g., seismic applications).

Various different types of detonators can be used for initiating explosive devices. There are at least two types of detonators, electrical and percussion. A percussion detonator is activated by a mechanical force. An electrical detonator is electrically activated. A type of electrical detonator is referred to as an electro-explosive device, which includes as examples hot-wire detonators, semiconductor bridge detonators, or exploding foil initiator (EFI) detonators.

An issue associated with conventional detonators is the ability to precisely control the timing or other stimulus for activating the detonators. If precise control of activation of a detonator is not available, then optimal downhole operations involving explosive devices may not be achievable.

SUMMARY

In general, according to one embodiment, a detonator assembly for initiating an explosive comprises a power source, an initiator, and a switch coupled between the power source and initiator. The switch has a trigger input to receive a stimulus to activate the switch, where activation of the switch causes electrical energy to be provided to the initiator. The stimulus comprises at least one of a clock-based stimulus, a pressure stimulus, a light stimulus, an acoustic stimulus, a vibration stimulus, or an electromagnetic stimulus.

Other or alternative embodiments will be apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, diagonal, or other relationship as appropriate.

Figure 1:
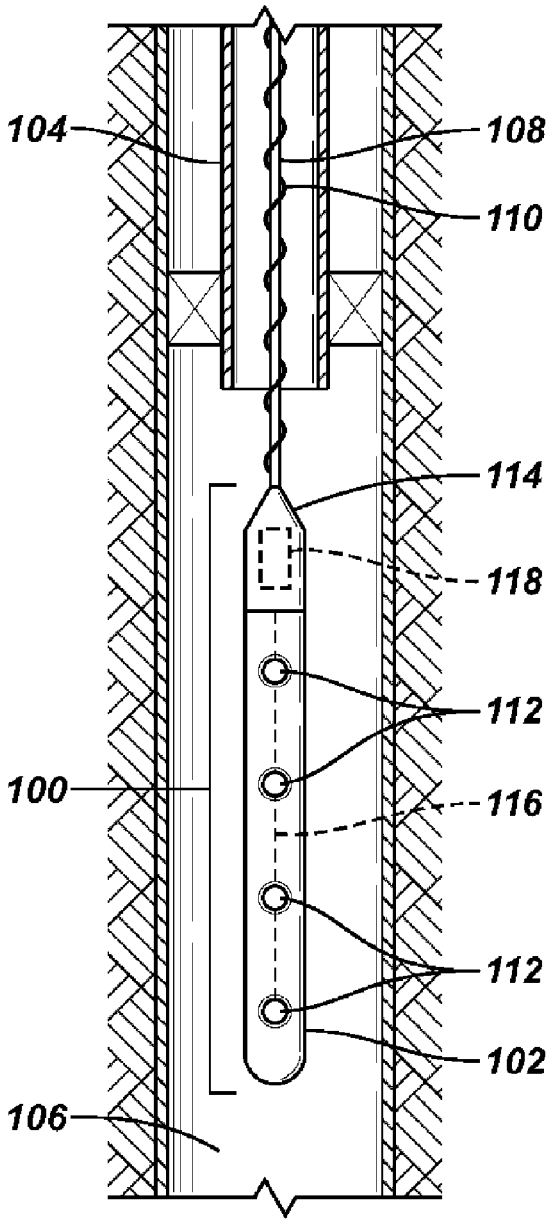
FIG. 1 illustrates a downhole tool containing an explosive and a detonator assembly according to an embodiment.

Referring to FIG. 1, a downhole tool 100 includes a perforating gun 102 or other type of tool that includes an explosive. The perforating gun 102 is used to create perforations into the surrounding casing and formation. Examples of other tools having explosives include tools for cutting downhole structures, tools for activating packers, and so forth. As depicted in the example implementation of FIG. 1, the tool 100 is lowered into a wellbore 106 through a tubing 104 (e.g., a production tubing). In a different implementation, the tubing 104 is omitted.

The tool 100 is lowered on a deployment structure 108, such as a wireline, coiled tubing, or other conveyance structure. A cable 110 is provided in the deployment structure 108 for providing power and/or signaling to the tool 100. Examples of the cable 110 include an electrical cable for communicating electrical signaling, a fiber optic cable for communicating light signaling, a hydraulic cable for communicating hydraulic pressure, and so forth.

The perforating gun 102 includes explosive devices 112 (in the form of shaped charges) that are coupled to a firing head 114 by a connection link 116. The connection link 116 can be a ballistic connection link, such as a detonating cord. Alternatively, the connection link 116 can be an electrical link, such as one or more electrical wires.

The firing head 114 includes a detonator assembly 118 according to an embodiment. The detonator assembly 118 includes a power source, an initiator, and a switch coupled between the power source and the initiator. The switch includes a trigger input for receiving signaling corresponding to one or more stimuli, which includes at least one of a clock-based stimulus, a pressure stimulus, a light stimulus, an acoustic stimulus, a vibration stimulus, and an electromagnetic stimulus. The one or more stimuli are provided by one or more stimulus generating devices that can be part of the detonator assembly 118. However, in an alternative implementation, the stimulus generating device(s) can be separate from the detonator assembly 118 in the firing head 114.

Instead of a single detonator assembly 118 according to an embodiment coupled by the connection link 116 to explosive devices 112, individual detonating assemblies can be provided adjacent respective explosive devices 112, such that the detonator assemblies are activated by one or more stimuli provided by the stimulus generating device(s) over the connection link 116. The detonator assemblies associated with respective explosive devices 112 can be activated concurrently by the one or more stimuli from the stimulus generating device(s) 118. Alternatively, multiple stimuli outputs can be provided by the stimulus generating device(s) 118 such that the detonator assemblies associated with the explosive devices 112 are separately activated.

FIG. 1 illustrates an example implementation of a tool in a wellbore environment that employs a detonator assembly, or plural detonator assemblies, according to some embodiments. Note that other types of tools in a downhole well environment can also use detonator assemblies according to some embodiments. Additionally, similar detonator assemblies can be employed in other types of applications, such as mining applications, seismic applications, and so forth.

Figure 2:
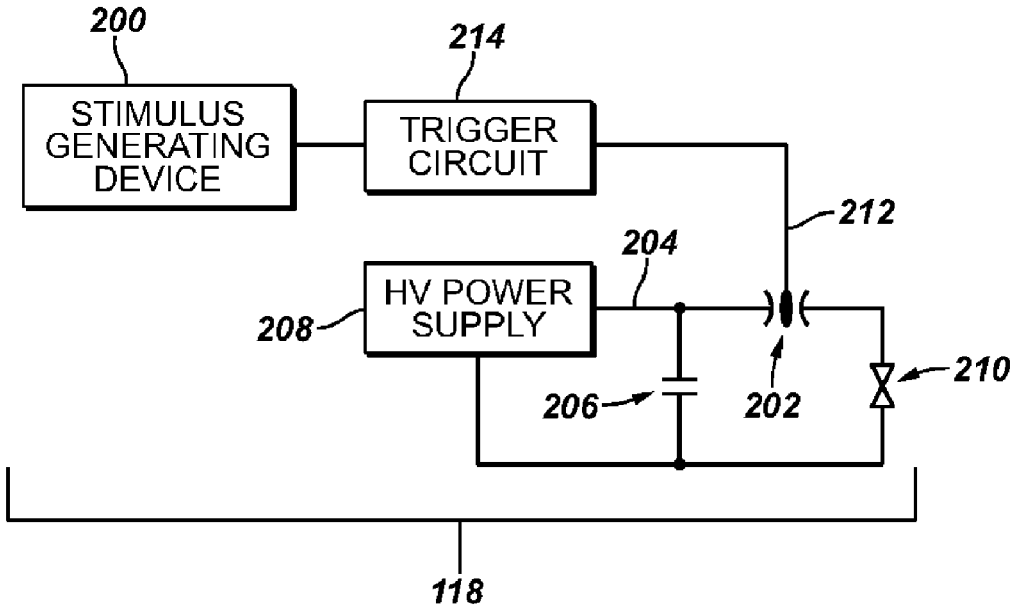
FIG. 2 is a block diagram of a detonator assembly according to an embodiment.

FIG. 2 is a schematic diagram illustrating the detonator assembly 118 according to an embodiment in greater detail. The detonator assembly 118 includes components that receive a stimulus input from a stimulus generating device 200.

The detonator assembly 118 includes a switch 202 that has a first input 204 coupled to a power source 206. In one embodiment, the power source 206 is in the form of a capacitor. Alternatively, the power source 206 can include a battery or some other type of power source. A high-voltage power supply 208 supplies electrical energy to charge the power source 206. Note that the high-voltage power supply 208 can either be part of the detonator assembly 200, or it can be located at a remote location, such as at the earth surface of a well. If the power supply 208 is located at a remote location, then electrical energy from the power supply 208 is supplied to the detonator assembly 200 over an electrical cable.

In another implementation, the power supply 208 can be a battery, or the power supply 208 can receive light energy, acoustic energy, hydraulic energy, or another type of energy, and convert the received energy into electrical energy for powering the power source 206.

The detonator assembly 118 also includes an initiator 210. In one embodiment, the initiator 210 is an exploding foil initiator (EFI). In other embodiments, other types of initiators can be used, such as a hot-wire detonator, a semiconductor bridge detonator, and so forth.

The switch 202 is connected between the power source 206 and the initiator 210. When the switch 202 is in the open position, the initiator 210 is electrically isolated from the power source 206. The switch 202 has a trigger input 212 that is connected to a trigger circuit 214. The trigger circuit 214 can be implemented as one or more electrical wires, can include switches, can include electrical devices such as integrated circuit devices, or can include any other type of circuitry to enable the activation of the trigger input 212 of the switch 202 in response to a stimulus provided by the stimulus generating device 200 that is received by the trigger circuit 214. For example, if the stimulus generating device 200 provides a non-electrical signal, such as an optical signal, an acoustic signal, or any other type of signal, the trigger circuit 214 can include components for translating such other types of signaling into electrical signaling for provision to the trigger input 212 of the switch 202.

The power source 206 stores electrical energy having a voltage level that is below the activation voltage of the switch 202. Provision of a trigger signal at the trigger input 212 causes the activation of the switch 202 to a closed state to connect the power source 206 to the initiator 210.

In one embodiment, the stimulus generating device 200 includes a clock. The clock can be synchronized at the earth surface, such that when the clock reaches a certain time point, the clock provides a stimulus indicating that the switch 202 should be activated.

Alternatively, the stimulus generating device 200 can include a pressure transducer and a comparator. The pressure transducer monitors a pressure in the environment surrounding the tool containing one or more explosive devices to be fired. The comparator compares the measured pressure from the pressure transducer against a threshold, and if the measured pressure has a predefined relationship with respect to the threshold (e.g., the measured pressure is greater than the threshold), the comparator provides a stimulus to the trigger circuit 214 for activating the switch 202.

In an alternative embodiment, the stimulus generating device 200 includes a light detector that detects light generated by other components in the tool or by light transmitted from the earth surface, such as through a fiber optic cable. Light can be generated in a downhole environment by activation of a detonating cord or activation of flash powder associated with explosive devices. One implementation of using a light detector includes providing multiple guns, where light generated by the firing of a first gun is detected by the light detector of a second gun. In a different implementation, the light is provided down a fiber optic cable from an earth surface. Upon detection of light, the light detector in the stimulus generating device 200 provides a stimulus output to the trigger circuit 214 for activating the switch 202.

In yet another arrangement, the stimulus generating device 200 can include a geophone or an accelerometer for detecting shock waves or other forms of vibration in a downhole environment. For example, the geophone or accelerometer can detect shock waves (or vibration) caused by detonation of another gun in the wellbore. Detection of this vibration caused by firing of the other gun or by some other event causes the geophone or accelerometer in the stimulus generating device 200 to provide a stimulus output to the trigger circuit 214 for activating the switch 202.

Alternatively, the stimulus generating device 200 includes an acoustic detector to detect acoustic signals or an electromagnetic detector to detect electromagnetic signals.

In yet other arrangements, combinations of two or more of the above components (clock, pressure transducer, light detector, geophone, accelerometer, acoustic detector, and electromagnetic detector) can be used. In such an arrangement, the stimulus generating device 200 provides an activation signal to the switch in the detonator assembly based on a combination of stimuli (e.g., clock-based stimulus plus another stimulus).

Figure 3:
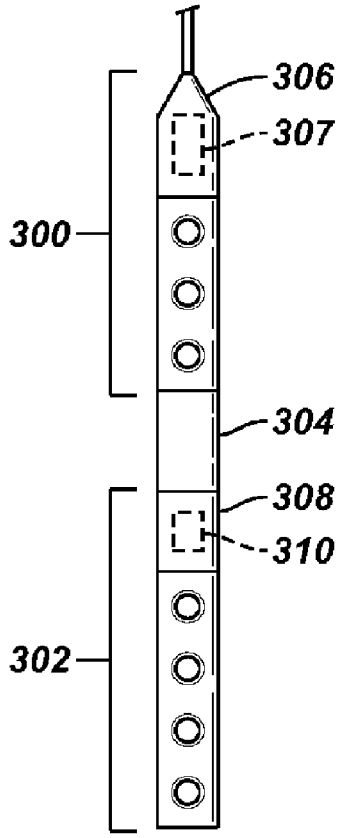
FIG. 3 illustrates a downhole tool according to another embodiment.

FIG. 3 shows an example tool string that includes multiple guns 300 and 302 that are spaced apart by a spacer 304. The upper gun 300 includes a firing head 306, which can be activated by any of a number of techniques, including use of a detonator assembly 307 according to an embodiment (similar to the detonator assembly 118 of FIG. 2). The lower gun 302 also includes a firing head 308 that includes a detonator assembly 310 according to some embodiments. The detonator assembly 310 includes a stimulus generating device that is similar to the stimulus generating device 200 of FIG. 2. The stimulus generating device of the detonator assembly 310 can include a light detector to detect light caused by firing of the upper gun 300. Alternatively, the stimulus generating device of the detonator assembly 310 can include a geophone or accelerometer for detecting vibration caused by firing of the upper gun 300.

In an alternative arrangement, stimulus generating devices associated with detonator assemblies 307 and 310 can also include clocks that are synchronized with respect to each other. In response to some external stimulus, the clocks can be started such that the firing heads 306 and 308 are activated at the same time or in some predetermined sequence.

Figure 4:
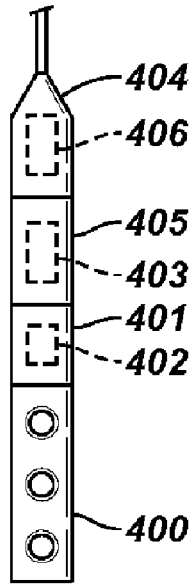
FIG. 4 illustrates a downhole tool according to yet another embodiment.

FIG. 4 shows another embodiment of a tool that includes a gun 400, an explosive device 403, a firing head 401 having a detonator assembly 402 for the gun 400, and a firing head 404 having a detonator assembly 406 for the explosive device 403. The detonator assemblies 402 and 406 can be similar to the detonator assembly 118 of FIG. 2.

The stimulus generating devices in the detonator assemblies 402 and 406 can include clocks that are activated by some external stimulus. The external stimulus can be detected by one or more of a light detector, pressure transducer, vibration detector, acoustic detector, or some other detector. The clocks may be set such that the explosive device 403 is first detonated by the detonator assembly 404, such as to create an underbalance condition in the wellbore environment surrounding the gun 400. For example, the explosive device 403 can be located inside a sealed chamber 405 that is at a low pressure (e.g., atmospheric pressure). Activation of the explosive device 403 causes opening(s) to be created in the chamber 405 to cause fluid and pressure communication between the surrounding wellbore interval and the chamber 405. This communication causes a transient underbalance condition to occur around the gun 400. Following some preset time period based on the clock in the detonator assembly 402, the detonator assembly 402 fires the gun 400, where such firing occurs in an underbalance condition for performing underbalanced perforation.

Figure 5:
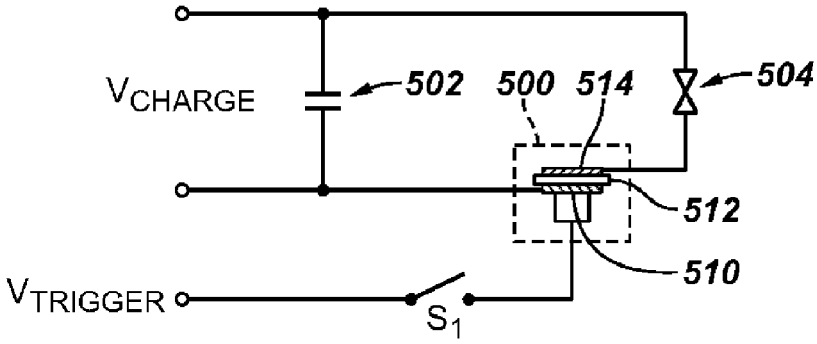
FIGS. 5 and 6 illustrate embodiments of the detonator assembly.

FIG. 5 shows an example embodiment of a detonator assembly that employs a diode switch 500. A power source 502, implemented as a capacitor, is charged by a charging voltage $V_{CHARGE}$. For example, the charging voltage can be set to about 800-1,500 volts DC (VDC). A trigger voltage $V_{TRIGGER}$, is provided through a switch S1 to the diode switch 500. As an example, the trigger voltage, $V_{TRIGGER}$, can be set to a voltage between 200-500 VDC. When the switch S1 is closed, the switch S1 initiates a current flow into a diode 506 of the diode switch 500, which causes the diode 506 to avalanche. In another arrangement, the switch S1 can be omitted, with the trigger voltage $V_{TRIGGER}$, coupled directly to the diode 506. The diode 506 can be a Zener diode, according to one embodiment.

The diode 506 is electrically attached to a first conductor layer 510 of the diode switch 500. The P/N junction of the diode 506 faces the conductor layer 510, which may be at a ground potential or some other potential. The diode switch 500 also includes a second conductor layer 514 that is spaced apart from the first conductor layer 510 by an insulator layer 512. When the diode 506 is forced into an avalanche condition by applying the trigger voltage $V_{TRIGGER}$, the P/N junction of the diode 506 breaks down, which generates a plasma that perforates a hole through the layers 510, 512, and 514 of the diode switch 500. The plasma creates a conductive path between the conductor layers 510 and 514, which causes the switch 500 to close and conduct for the duration required to electrically couple the charged capacitor 502 to an initiator 504.

Figure 6:
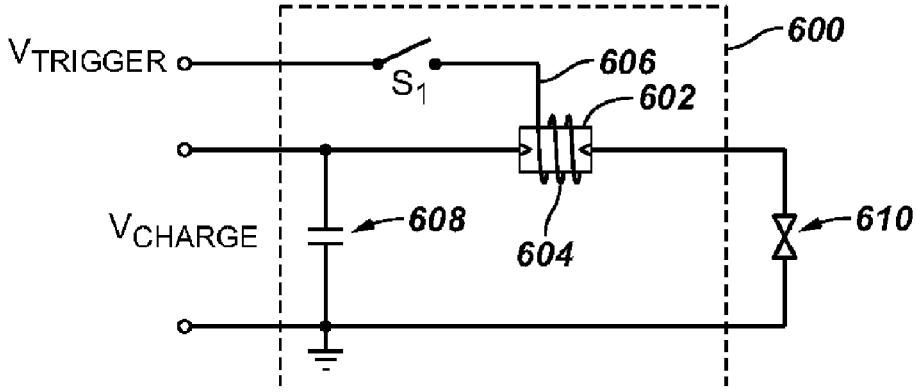

FIG. 6 discloses a different embodiment of the detonator assembly that includes an over-voltage switch implemented as a spark gap 602. A wire 604 is wound around the spark gap 602. The detonator assembly 600 also includes a capacitor 608 that is charged to a voltage, which is less than the voltage needed to cause the spark gap 602 to close. A trigger anode 606 is connected to the wire 604, with the trigger anode 606 coupled through a switch S1 to a trigger voltage, $V_{TRIGGER}$. Upon closure of the switch S1, the spark gap 602 goes in conduction and dumps the capacitor charge into an initiator 610.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A downhole tool, comprising:

a perforating gun;

a plurality of shaped charges in the perforating gun that are spaced at different distances longitudinally along the length of the perforating gun, the plurality of shaped charges being connected to one another by a connection link;

a power source;

an initiator;

a switch coupled between the power source and the initiator, the switch having a trigger input responsive to a stimulus to activate the switch, activation of the switch to cause electrical energy to be provided from the power source to the initiator, thereby detonating the shaped charges; and a stimulus generating device to provide a signal to the trigger input of the switch in response to the stimulus.

2. The downhole tool of claim 1, wherein the stimulus generating device comprises a clock.

3. The downhole tool of claim 1, wherein the stimulus generating device comprises a pressure transducer.

4. The downhole tool of claim 1, wherein the stimulus generating device comprises an accelerometer.

5. The downhole tool of claim 1, wherein the stimulus generating device comprises a light detector.

6. The downhole tool of claim 1, wherein the stimulus generating device comprises an acoustic detector.

7. The downhole tool of claim 1, wherein the power source comprises a capacitor.

8. The downhole tool of claim 1, wherein the initiator comprises an exploding foil initiator.

9. The downhole tool of claim 1, wherein the stimulus comprises a clock-based stimulus.

10. The downhole tool of claim 1, wherein the stimulus comprises a pressure stimulus.

11. The downhole tool of claim 1, wherein the stimulus comprises a light stimulus.

12. The downhole tool of claim 1, wherein the stimulus comprises a acoustic stimulus.

13. The downhole tool of claim 1, wherein the stimulus comprises a vibration stimulus.

14. The downhole tool of claim 1, wherein the stimulus comprise an electromagnetic stimulus.

15. The downhole tool of claim 1, wherein the initiator comprises a hot-wire detonator.

16. The downhole tool of claim 1, wherein the initiator comprises a semiconductor bridge detonator.

17. The downhole tool of claim 1, wherein the stimulus generating device comprises a geophone.

18. The downhole tool of claim 1, wherein the switch is an over-voltage switch.

19. The downhole tool of claim 18, wherein the over-voltage switch includes a spark gap that goes into electrical conductance to connect the power source to the initiator upon provision of the signal to the trigger input.

20. The downhole tool of claim 1, wherein the perforating gun is a first perforating gun that includes the plurality of shaped charges, the power source, the initiator, the switch, and the stimulus generating device, the downhole tool further comprising:

a second perforating gun;

a second plurality of shaped charges in the second perforating gun, the second plurality of shaped charges being connected to one another by a second connection link;

a second power source in the second perforating gun;

a second initiator in the second perforating gun;

a second switch in the second perforating gun coupled between the second power source and the second initiator, the second switch having a trigger input responsive to a second stimulus to activate the second switch, activation of the second switch to cause electrical energy to be provided from the second power source to the second initiator, thereby detonating the second shaped charges; and a second stimulus generating device in the second perforating gun to provide a signal to the trigger input of the second switch in response to the second stimulus, wherein the second stimulus generating device is responsive to a different type of stimulus than the first stimulus generating device.

* * * * *